United States Patent [19]

Jones

[11] 4,084,364

[45] Apr. 18, 1978

[54] COMPRESSION STRUT FOR SUSPENDED CEILING

[75] Inventor: Donald P. Jones, Lockeford, Calif.

[73] Assignee: Roblin Industries, Inc., Buffalo, N.Y.

[21] Appl. No.: 675,706

[22] Filed: Apr. 12, 1976

[51] Int. Cl.[2] ..... E04B 5/52

[52] U.S. Cl. ..... 52/484; 52/39; 248/354 R

[58] Field of Search ..... 52/39, 167, 225, 226, 52/483–488, 741; 248/354 R

[56] References Cited

U.S. PATENT DOCUMENTS

| | | | |
|---|---|---|---|
| 2,053,226 | 9/1936 | Ruge | 52/167 X |
| 3,212,466 | 10/1965 | Wintersteen | 110/99 B |
| 3,606,704 | 9/1971 | Denton | 52/167 |
| 3,769,774 | 11/1973 | Barnes | 52/39 X |
| 3,842,561 | 10/1974 | Wong | 52/484 |

FOREIGN PATENT DOCUMENTS

| | | | |
|---|---|---|---|
| 250,558 | 3/1964 | Australia | 52/484 |
| 683,385 | 2/1965 | Italy | 248/354 R |
| 944,068 | 12/1963 | United Kingdom | 52/484 |

*Primary Examiner*—J. Karl Bell

*Attorney, Agent, or Firm*—Christel & Bean

[57] ABSTRACT

A spring loaded compression strut adapted for mounting between the members of a suspended ceiling grid system and an overhead structural framework. The strut presses downwardly on the grid system so that the latter resists sudden upward movement as might be caused during an earthquake with the corresponding results that the integrity of the ceiling panel system is more adequately protected during such an event since the supporting grid members therefore are not subject to sudden, relative disorientation. The strut includes clip means at its upper and lower ends adapted for respective connection to the overhead structural framework and the grid members which enables the strut to be readily assembled with existing suspended ceiling systems since it is mounted in an external manner with respect to hanger wires found in such existing ceiling systems.

9 Claims, 7 Drawing Figures

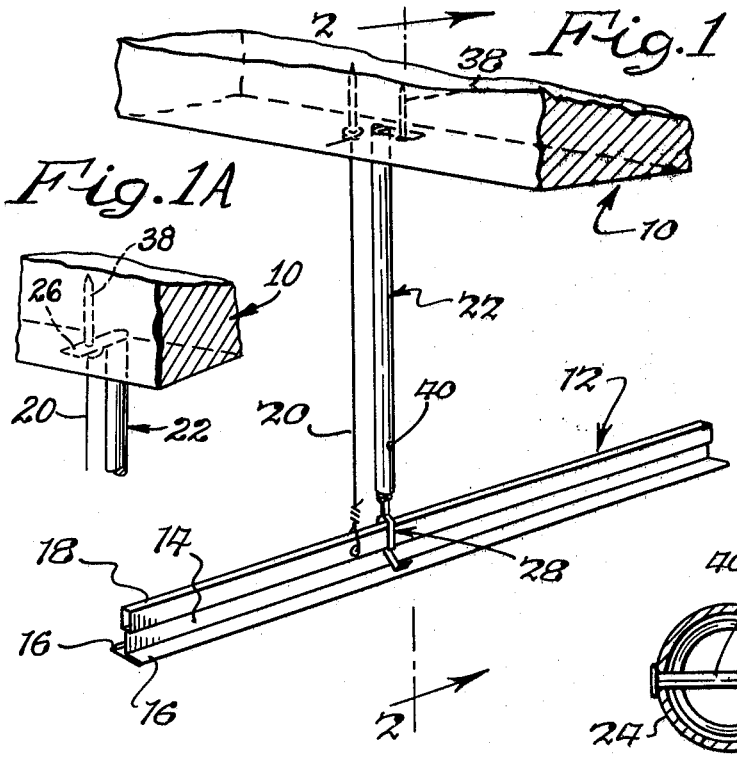
Fig. 1
Fig. 1A
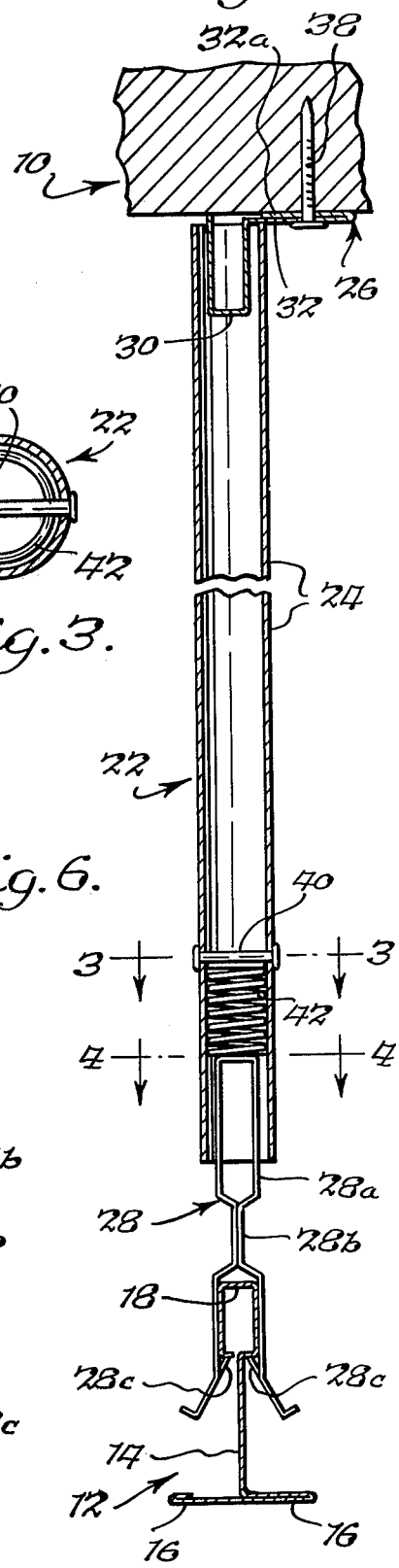
Fig. 2.
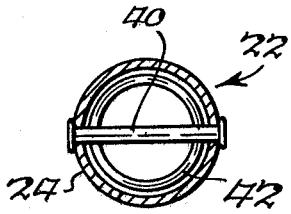
Fig. 3.
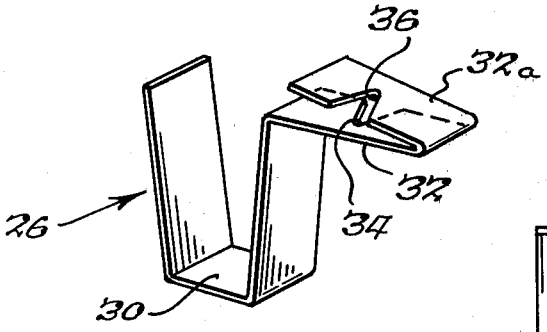
Fig. 5.
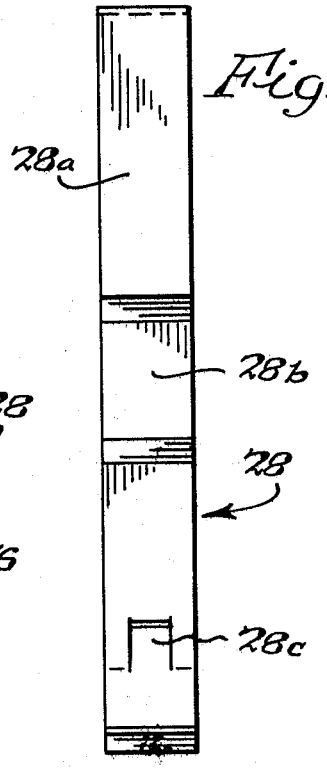
Fig. 6.
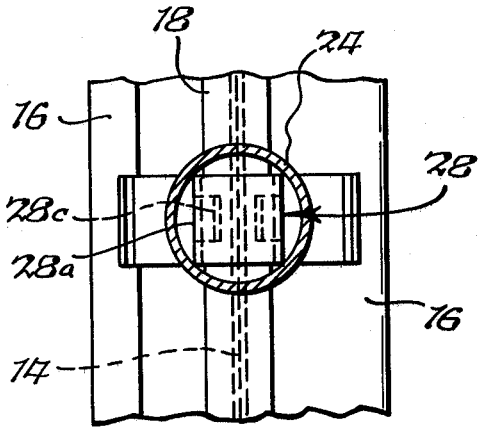
Fig. 4.

COMPRESSION STRUT FOR SUSPENDED CEILING

BACKGROUND OF THE INVENTION

This invention relates generally to suspended ceiling grid systems for supporting ceiling tiles and the like, and more particularly to means for controlling the vertical components of movement of such a ceiling system as might occur during an earthquake. The compression strut forming the present invention controls such vertical movement of the suspended ceiling without substantial buckling of the supported ceiling tiles as might otherwise occur during an eathquake tremor, thereby preserving the integrity of the suspended ceiling surface.

The present invention is particularly adapted for use in ceiling tile supporting grid systems of the type comprising a plurality of parallel, spaced main grid members which may include cross grid members extending transversely between the main grid members and having end portions interlocking therewith. Such grid members generally are suspended from a conventional ceiling or an overhead support structure framework.

A critical problem encountered in the aforesaid ceiling tile supporting grid structures is to maintain the integrity of the ceiling under sudden movements, such as accompany earthquakes and earthquake tremors. Although the ceiling systems normally resist lateral movement due to engagement with surrounding vertical wall surfaces, the grid systems are subject to upward movement which can result in disorientation of the relative arrangement of grid members. The latter movement results in the ceiling tiles becoming disengaged from a properly mounted position on the grid members with the very likely result of their falling to the floor space below. Not only does such as occurrence present the danger of falling materials but the effectiveness of the suspended ceiling as a fire barrier in such a situation is destroyed and the overhead ceiling and related support structure could thereby be exposed to any related fire which could spread more easily and rapidly throughout the entire structure.

SUMMARY OF THE INVENTION

Accordingly, one object of the present invention is to provide a compression strut for suspended ceiling grid systems which urges such grid systems downwardly to resist upward movement which might accompany an earthquake or earthquake tremor or other similar phenomenon so as to preserve the integrity of a supported ceiling under such conditions.

Another object of the present invention is to provide the aforesaid compression strut member which may be easily installed into various types of suspended ceiling constructions.

A further object of the present invention is to provide the aforesaid strut member which may be easily installed in existing suspended ceiling systems without the need for disassembling such grid systems for installation of the strut.

In summary, the present invention provides a compression strut for ready engagement between a suspended grid system and the corresponding overhead framework structure. The strut includes a lower clip means and an upper clip means for respective connection to the grid system members and overhead framework, such connections being urged apart by an intermediately disposed compression spring. The compression spring is housed within a telescoping cylindrical member which forms the main body of the strut. The clip means to the strut are further adapted for connection to a hanger wire as employed in suspended ceiling grid systems whereby the strut may be mounted externally adjacent to such wires in an upright parallel manner.

The foregoing and other objects, advantages and characterizing features of the present invention will become clearly apparent from the ensuing detailed description of an illustrative embodiment thereof, taken together with the accompanying drawings wherein like reference characters denote like parts throughout the various views.

BRIEF DESCRIPTION OF THE DRAWINGS

FIG. 1 is a perspective view showing a grid member forming part of a suspended ceiling system as being supported by a hanger wire from an overhead superstructure with a compression strut forming the present invention disposed in a vertical disposition adjacent to said hanger wire;

FIG. 1A is a detailed perspective view similar to FIG. 1 wherein a hanger wire is affixed to an overhead superstructure in combination with a fastening means which maintains a compression strut in position with respect to the overhead superstructure;

FIG. 2 is a vertical view in section as taken about on line 2—2 of FIG. 1 through the axis of the compression strut in a plane perpendicular to the grid member connected thereto;

FIG. 3 is a transverse view in section as taken about on line 3—3 of FIG. 2 of the compression strut;

FIG. 4 is a transverse view of the compression strut as taken about on line 4—4 of FIG. 2, showing the underlying grid member in fragmentary form and the lower clip means of the compression strut attached to said grid member;

FIG. 5 is an enlarged perspective view of the upper clip means forming part of the compression strut; and FIG. 6 is an enlarged side view of the lower clip means associated with the compression strut.

DETAILED DESCRIPTION OF A PREFERRED EMBODIMENT

As shown on FIG. 1, an overhead frame or superstructure member 10 is shown in fragmentary form from which is suspended a grid member 12, the latter forming part of a grid network for a suspended accoustical ceiling system for example. The member 10 could be a wooden beam or any one of a variety of other types of superstructural members whereby a suspended ceiling is disposed in a horizontal plane in spaced relationship below such superstructural members, all of which is well know. The grid member 12 includes an upstanding web means 14 and laterally extending flange means 16, the latter functioning to support the edge portions of ceiling tiles or panels. The web means 14 is surmounted by a longitudinally extending bead means 18 which as shown in FIG. 3 and more clearly in FIG. 2 is of rectangular cross sectional configuration. As is well known in the trade, the grid member 12 is suspended from the overhead structural member 10 by means of a hanger wire 20. The hanger wire 20 can be connected at its upper end to the overhead member 10 in a variety of ways, depending on the nature of such overhead member. For purposes of illustration, the upper end of the hanger wire as shown is nailed into a lower surface of member 10 while the lower end of the hanger wire is threaded through an aperture in the bead means 18 and tied so as to space the grid member an appropriate distance below beam 10.

As is apparent from FIG. 1, the grid member 12 and the remainder of a similarly supported grid network is restrained against downward movement by the taut nature of the hanger wire, but could necessarily experience upward movement absent the compression strut 22 forming the present invention. Necessarily, should the grid member 12 move suddenly in an upward direction, the relative orientation of its tile supporting flanges 16 with respect to other tile supporting flanges would become disoriented with the result that the supported ceiling tiles would fall to the floor space below. Not only would this present a danger of falling objects to occupants of the room during an earthquake, such phenomenon being the most likely to cause the upward movement of the suspension system as considered herein, but also the falling ceiling tiles could allow the spread of fire as may very likely accompany an earthquake situation. It is in regard to such fires that it becomes highly important that the integrity of the mounted ceiling tiles be maintained as an effective fire barrier in preventing the spread of a fire in any one room to the overhead superstructure such as beam 10 and necessarily the remainder of a building.

Turning now to FIG. 2, the compression strut 22 is shown to include a hollow cylindrical body member 24 which telescopically engages an upper clip means 26 and a lower clip means 28. The upper clip means 26 as shown in detail in FIG. 5 includes a U-shaped base portion 30 having resiliently spaced leg portions for insertion into the upper end of body member 24 so that the laterally extending fastening means 32 engages the top lip of cylindrical member 24 as shown in assembled form in FIG. 2. As is further shown in FIG. 5, the fastening means 32 includes a reversely folded tab portion **32*a* which is somewhat resiliently spaced from portion 32. The portions 32 and 32*a* include V-shaped notches 34 and 36 respectively which are oriented in opposite directions and which will be more fully discussed herein below. As is apparent from FIG. 2, in the embodiment described herein, a nail 38 may be engaged through the notches 34 and 36 so as to firmly retain clip 26 in place with respect to beam 10 and necessarily fix the lateral position of the cylindrical tube member 22 with respect to beam 10**.

The lower end of cylindrical body member 24 includes a riveted bolt type element 40 passing horizontally through the axis of member 24. As seen in FIGS. 2 and 3 taken together, a spring means 42 is telescopically received within body member 24 and is restrained against relative upward movement with respect to member 24 by the bolt element 40. In turn, the upper portion of the clip means 28 includes a vertically extending portion **28*a* which is made rigid by the formed abutment of the clip wall portion 28*b*. The top surface of clip portion 28*a* is mounted to seat against a lower end of the compression spring 42**.

Furthermore, the lower portion of clip 28 is of inverted U-shaped configuration and is so formed to matingly engage the bead means 18 of a grid member 12. Such lower inverted U-shaped portion of the clip 28 includes detent means **28*c* which are biased inwardly towards one another for snap-fitting engagement underneath the lower surface of bead means 18 when the clip 28 is engaged downwardly over the bead means 18** of the grid member.

In utilizing the compression strut 22 of the present invention it is to be understood that the nominal length of the cylindrical body member 24 would be provided to generally correspond to the nominal spacing between a grid member 12 and overhead support member 10. Accordingly, the lower portion of clip 28 may be simply snapped down over a grid member 12 which is already in a mounted position and the upper clip member 26 fastened to the overhead structure. In this manner, the compression spring 42 will absorb variations in the vertical spacing between the grid system and the overhead structure while at the same time providing a compressive force to urge the clip means 28 downwardly in a relative sense in reaction to the fixed abutment of the upper end of the spring 42 against the bolt means 40 and attached strut body 24. The formed configuration of the inverted U-shaped on clip 28 effectively eliminates any looseness in its connection with the grid bead means 18 so that the grid is firmly urged downwardly against the restraint of the hanger wire 20 and thereby resists any sudden upward movement as referred to herein above.

One of the distinct advantages of the present invention is that it may be as easily employed with new grid systems as it can be in retrofitting older grid systems since the strut is assembled externally with respect to a hanger wire 20. In this regard, it is considered an advantage not to have the hanger wire 20 pass through the body member 24 inorderto maintain the latter in vertical alignment, since otherwise this would necessitate disassembly of such existing hanger wires or would make assembly of the strut more difficult in new systems. Accordingly, the use of the upper and lower clip means associated with the compression strut avoids this difficulty. Furthermore, it should be noted that the clip 26 has been described as affixed to beam 10 by means of nail 38. However, in mounting the strut 22 adjacent to a hanger wire 20, the clip 26 could be manipulated to pass as assembled hanger wire 20, between portions 32 and **32*a* thereof so that the wire would pass through the aligned notches 34 and 36 when the clip 26 is vertically disposed within the upper portion of the strut body 24. Such an assembly would firmly retain the upper portion of the strut in a laterally fixed position and would avoid the need for utilizing the nail 38 as shown in FIG. 2. In fact, the use of such a nail 38 could in fact be impossible if the hanger wire 20** were suspended or tied to overhead structural steel members for example.

From the foregoing, it is apparent that the objects of the present invention have been fully accomplished. As a result of this invention, a compression strut for a suspended ceiling is provided for maintaining the integrity of such a ceiling structure during an earthquake situation and to thereby preserve the fire retarding qualities thereof by preventing the spread of heat and fire to overhead structure.

Having thus described and illustrated a preferred embodiment of my invention, it will be understood that such modifications and changes as may suggest themselves to those skilled in the art are intended to fall within the scope of the present invention as limited only by the appended claims.

I claim:

1. The combination of a suspended ceiling grid system and an overhead structural framework extending thereabove from which said grid system is supportably suspended by a plurality of hanger means, and at least one compression strut extending between said grid system and said overhead framework, said compression strut including freely resilient spring means whereby said strut presses downwardly on said grid system in a resilient manner so that the latter resists upward movement at all times.

2. The combination as set forth in claim 1 wherein said strut is mounted adjacent to said hanger means and in a substantially parallel manner thereto.

3. The combination as set forth in claim 2 wherein said strut includes an upper end in connection with said overhead framework, a lower end in connection with said grid system and a compressible spring means disposed intermediate to and connecting said upper and lower ends one to another.

4. The combination as set forth in claim 3 wherein said strut further includes a hollow, cylindrical body portion telescoped over said spring means and extending in a coaxial manner therewith whereby said strut ends are urged apart one from another by said spring means.

5. The combination with a suspended ceiling grid system and an overhead structural framework extending thereabove from which said grid system is supportably suspended by a plurality of hanger means, of at least one compression strut extending between said grid system and said overhead framework, said compression strut including spring means whereby said strut presses downwardly on said grid system so that the latter resists upward movement, said strut being mounted adjacent to said hanger means and in a substantially parallel manner thereto and including an upper end in connection with said overhead framework, a lower end in connection with said grid system and said spring means being compressably disposed intermediate to and connecting said upper and lower ends one to another, said strut further including a hollow cylindrical body portion telescoped over said spring means and extending in a coaxial manner therewith whereby said strut ends are urged apart one from another by said spring means and clip means on said upper end connecting said strut to said overhead framework and clip means on said lower end connecting said strut to said ceiling grid system with a least one of said clip means extending laterally of said strut and being in connection with said hanger means disposed externally adjacent to said cylindrical body.

6. The combination as set forth in claim 5 wherein said hanger means comprises a wire and said laterally extending clip includes a notched portion adapted to engage said hanger wire after the latter is in assembled position.

7. The combination as set forth in claim 5 wherein said grid system includes a plurality of grid members, with at least certain of said grid members including an upstanding web means and flange means extending laterally therefrom for the support of ceiling panels, and said web means further being surmounted by a longitudinally extending bead means of hollow, cylindrical configuration having a lower surface extending laterally on at least one side of said web means, and said lower clip means being of inverted U-shaped configuration for engagement over said grid member bead means and having detent means for snap-fitting engagement underneath said lower surface of said bead means so that said compression strut is affirmatively retained in an appropriately mounted disposition.

8. The combination as set forth in claim 5 wherein said hanger means comprises a wire and said upper clip means includes a notched portion adapted to engage said hanger wire after the latter is in assembled position, with at least certain of said grid members including an upstanding web means and flange means extending laterally therefrom for supporting ceiling panels, and said web means further being surmounted by a longitudinally extending bead means of hollow, cylindrical configuration having a lower surface extending laterally from at least one side of said web means, and said lower clip means being of inverted U-shaped configuration for engagement over said grid member bead means and having detent means for snap-fitting engagement underneath said lower surface of said bead means so that said compression strut is affirmatively retained in an appropriately mounted disposition.

9. The combination with a suspended ceiling grid system and an overhead structural framework extending thereabove from which said grid system is supportably suspended by a plurality of hanger means, of at least one compression strut extending between said grid system and said overhead framework, said compression strut including compression means whereby said strut presses downwardly on said grid system so that the latter resists upward movement, said strut being mounted adjacent to said hanger means and in a substantially parallel manner thereto and including an upper end in connection with said overhead framework, a lower end in connection with said grid system and said compression means being disposed intermediate to and connecting said upper and lower ends one to another, said strut further including a hollow cylindrical body portion telescoped over at least a portion of said compression means and extending in a coaxial manner therewith whereby said strut ends are urged apart one from another by said compression means and means on said upper end extending laterally of said strut and being in connection with said hanger means disposed externally adjacent to said cylindrical body so as to laterally position said strut with respect to said overhead framework and means on said lower end connecting said strut to said ceiling grid system.

* * * * *